United States Patent [19]

Harrah

[11] 3,968,526

[45] July 13, 1976

[54] FLUSH TOILET AND METHOD

[75] Inventor: Robert E. Harrah, Willits, Calif.

[73] Assignee: Microphor, Inc., Willits, Calif.

[22] Filed: Aug. 21, 1974

[21] Appl. No.: 499,114

[52] U.S. Cl. ..... 4/79; 4/80

[51] Int. Cl.[2] ..... E03D 5/012

[58] Field of Search ..... 4/1, 10, 11, 15, 41, 4/67 R, 76, 79, 80, 84, 85, 26, 249, 89, 90, DIG. 3

[56] References Cited

UNITED STATES PATENTS

| | | | |
|---|---|---|---|
| 3,214,772 | 11/1965 | Roberts et al. | 4/79 |
| 3,538,517 | 11/1970 | Cornish et al. | 4/10 |
| 3,566,415 | 3/1971 | Culp | 4/76 X |
| 3,643,265 | 2/1972 | Wisell, Jr. | 4/10 |
| 3,698,019 | 10/1972 | Culp | 4/10 |
| 3,720,962 | 3/1973 | Harrah | 4/41 X |

*Primary Examiner*—Richard E. Aegerter
*Assistant Examiner*—Stuart S. Levy
*Attorney, Agent, or Firm*—Flehr, Hohbach, Test, Albritton, & Herbert

[57] ABSTRACT

An improved control system (apparatus and method) for a low-water/air-flush toilet system which effects a simultaneous reduction in the amounts of water and compressed air required for flushing the toilet. The system employs an improved spool valve control mechanism to initially water-flush the bowl portion of a toilet combination and thereafter to air-flush a base portion of the toilet combination, in a sequentially controlled operation. The improved control system is particularly adapted to compact biological or chemical waste treating systems for mobil units (e.g., in rail cars, buses, boats, aircraft, etc.), but is also effective with conventional toilets or waste treating systems.

9 Claims, 8 Drawing Figures

FLUSH TOILET AND METHOD

SUMMARY OF THE INVENTION AND OBJECTS

This invention relates generally to toilet flushing control systems and is particularly directed to improved control methods and means for effecting the flushing of toilet systems of the type disclosed, for example, in Harrah U.S. Pat. No. 3,720,962.

In general, one object of the invention is to improve upon the construction of control systems for such purpose, particularly with respect to means by which a combined water and compressed air flushing of a toilet combination can be rapidly accomplished, with greatly reduced amounts of water and air.

Another object of the invention is to provide an improved control system of the type described, based on use of a simple spool valve control, to thereby eliminate mechanical parts and linkages of the type normally subject to malfunction, corrosion, abrasion and like wear and tear.

Another object of the invention is to provide an improved toilet control system of such character which is very simple in construction, and which may be readily and inexpensively fabricated from conventional components.

A particular object of the invention is to provide a simple, inexpensive, highly effective control system for a combined water and air flush toilet, wherein the amount of water and particularly the amount of compressed air required for the flushing operation, is reduced to a minimum.

A still further object of the invention is to provide an improved method for controlling the operation of a combined water and air flush toilet which requires very little compressed air, and which virtually eliminates uncontrolled loss of compressed air.

Additional objects and advantages of the invention will appear from the following description in which an illustrative embodiment has been set forth in detail in conjunction with the accompanying drawings.

DETAILED DESCRIPTION OF PREFERRED EMBODIMENTS

Generally stated, and with particular reference to toilet systems of the type disclosed in Harrah U.S. Pat. No. 3,720,962, the improved control system of the present invention makes use of a spool valve mechanism to insure that a carefully controlled sequence of flushing operations takes place with use of minimum amounts of flush water and compressed air, to effectively discharge the contents of a flushing toilet or water closet. In accordance with the invention, the spool valve control mechanism is sequentially operable, upon demand: to simultaneously open the toilet bowl to a normally sealed air chamber below the toilet bowl, while introducing flushing water to discharge the contents of the toilet bowl into the chamber; to seal the air chamber from the toilet bowl while the latter continues to be filled with clean water; and for a relatively short period of time, to introduce gas under pressure (compressed air) to effectively discharge the water and contents of the sealed chamber with use of a minimum amount of compressed air. Manually responsive actuating means initiate a controllable shifting movement of the spool valve, which regulates the sequence and periods of the flushing operations.

In general, the spool valve control mechanism provides a sequentially controlled operation of sealing means located between the toilet bowl and air chamber, of means delivering flushing water to the toilet bowl, and of means delivering compressed air to the base chamber to effect the final discharge to waste. The described control system and its operation has particular utility with compact, self-contained toilet units such as find use in homes and business establishments and within mobil installations for rail cars, aircraft, buses, boats and the like. It provides the particular advantage of greatly reduced requirements for water and compressed air in the flushing operations, together with very small space requirements for the control unit, itself. A further advantage is that the system operates automatically in response to random demand, in a virtually maintenance-free operation.

Figure 1:
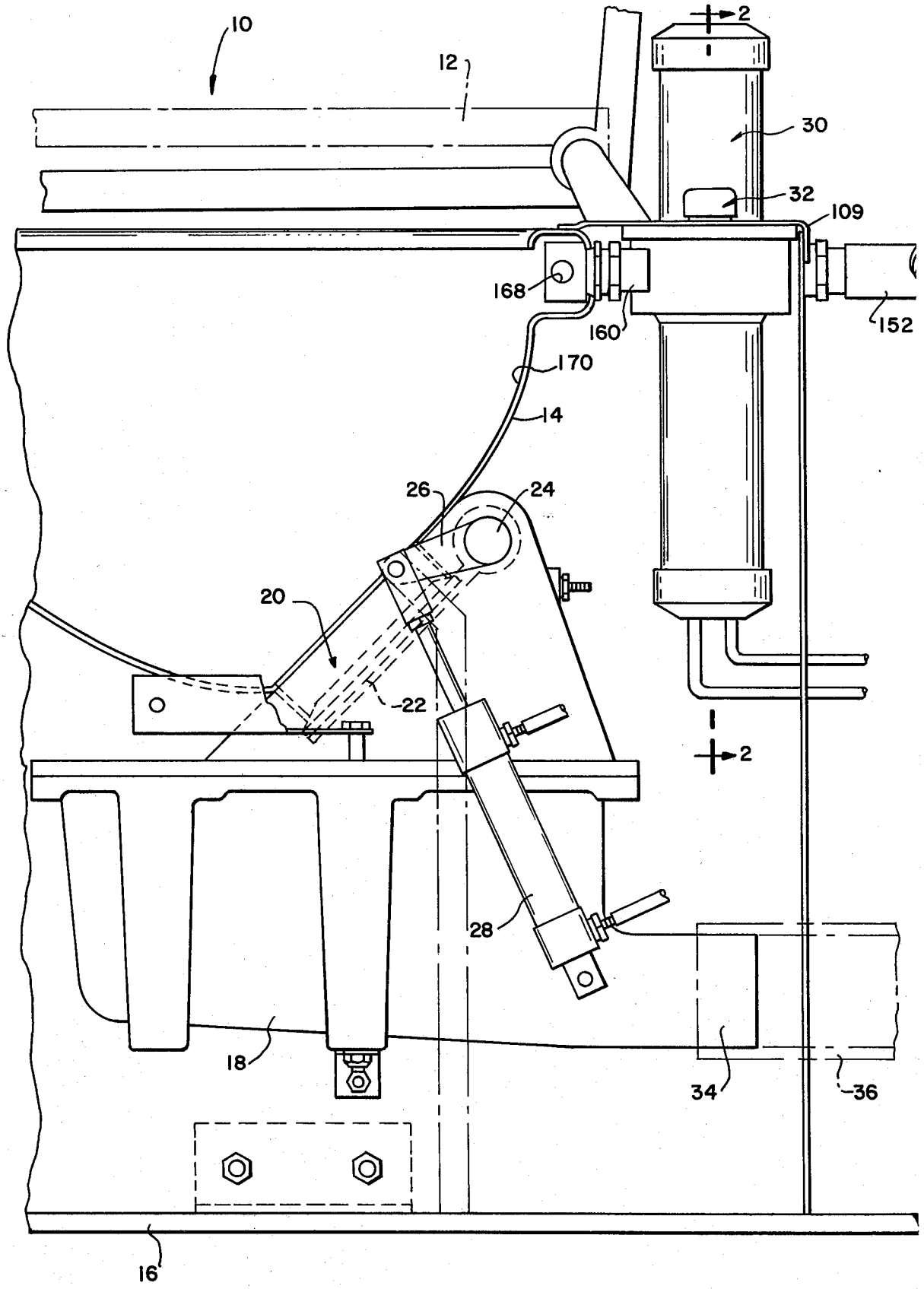
FIG. 1 is a view partly in section and partly in elevation of a toilet combination embodying the improved control system of the present invention.

Referring to the drawings in detail, FIG. 1 illustrates a particular system of apparatus in accordance with the present invention, wherein reference numeral 10 represents a flush toilet provided with a seat 12 and having a bowl portion 14. The bowl portion is integral with or mounted upon a supporting base 16 which includes a substantially airtight chamber 18. The toilet bowl 14 may communicate with the base chamber 18 though the passage 20, but is normally closed or sealed from the base chamber by means of an airtight seal or closure 22. In the illustrated apparatus, the closure member 22 is a flapper which is pivotally mounted on a transverse support rod 24. The latter is provided with a crank arm 26 which is pivotally connected to the piston rod of an actuating air cylinder 28. As will be understood, the flapper 22 can be pivoted between open and closed positions, as reflects the passage 20, to selectively open the toilet bowl 14 to the base chamber 18. As hereinafter described, control cylinder 28 for the closure 22 is operated by spool valve control means, as generally represented at 30, which is actuated by a pushbutton control 32. It is a feature of the invention that both the spool valve control mechanism 30 and the actuating means 32 can be accommodated within a very small space immediately adjacent the toilet unit.

Upon air flushing of the base chamber 18, as hereinafter described, the contents are discharged through a relatively small diameter outlet conduit 34, which may be in communication with any conventional waste disposal system, through the discharge conduit 36. For example, in compact systems for mobil units, the waste disposal system might be a chemical system, or a microbiological system as disclosed in Burton U.S. Pat. No. 3,238,124. Alternatively, the toilet unit might be discharged into a conventional municipal waste disposal system, a septic tank, leach line system, etc.

Figure 2:
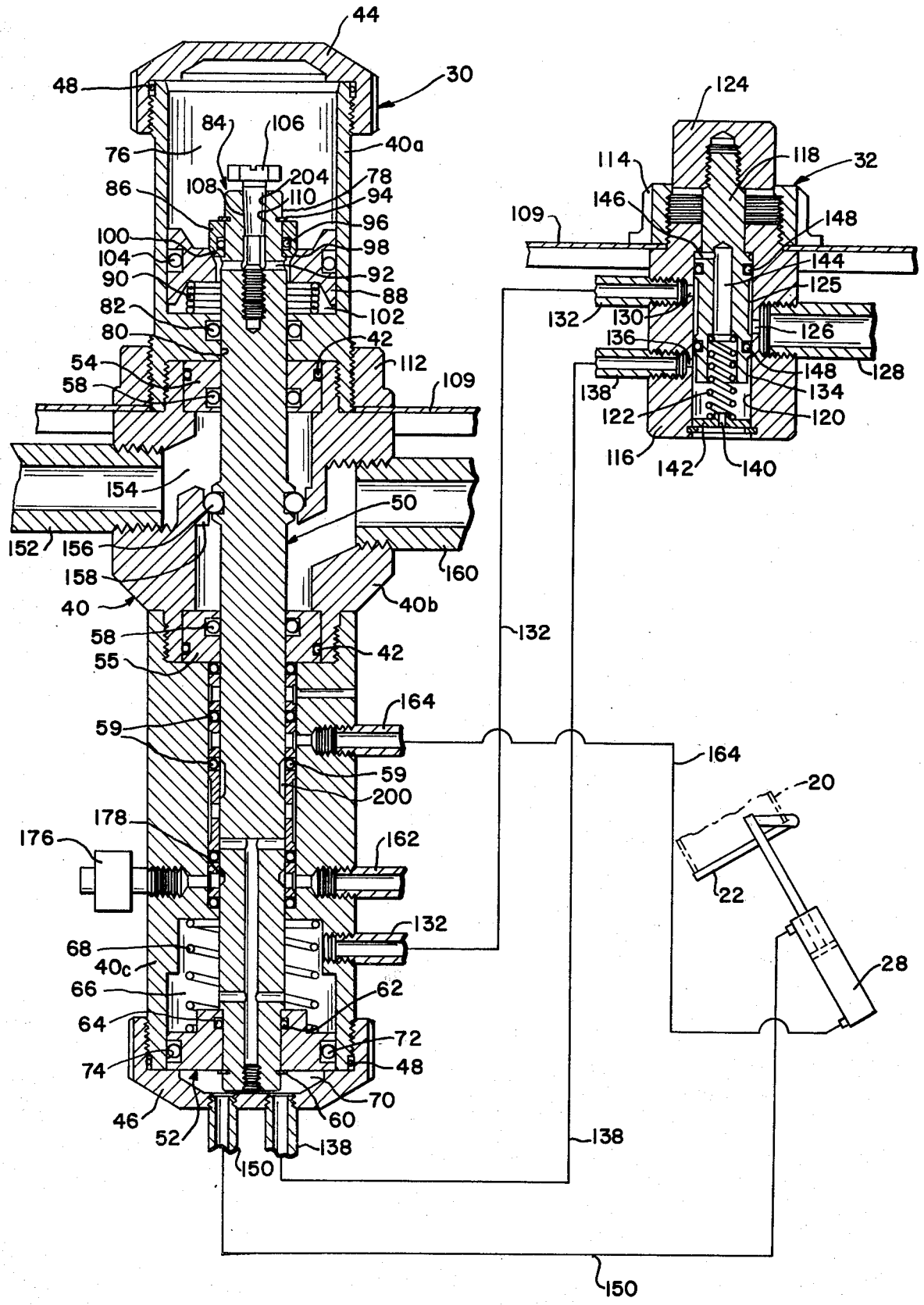
FIG. 2 is, in part, an enlarged sectional view along the line 2—2 of FIG. 1, and, in part, a schematic view thereof.

The internals of the spool valve control 30 and the actuating mechanism 32 are shown in FIG. 2, which also shows a "rest" position of the system. As illustrated, the spool valve mechanism includes an outer body portion 40 which may be conveniently assembled from separate components, represented at 40*a*, 40*b*, and 40*c*. The latter may be threadedly engaged and provided with appropriate sealing, as represented by the O-rings 42, to provide a leaktight assembly. End closures 44 and 46 complete the body assembly, and may likewise be provided with appropriate sealing, as represented by the O-rings 48. Mounted for longitudinal sliding movements within the body is a spool rod and piston assembly, including the spool rod 50 and piston 52. The spool rod 50 is received and supported within spaced bores or bearings, including a bearing 54 mounted between the body components 40*a* and 40*b*, a bearing 55 mounted between the body components 40*b* and 40*c* and an air-passage-forming bearing sleeve (or sleeves) as generally represented at 56. Sealing members such as O-rings 58 are received within the bearings 54 and 55 to slidably engage the spool rod 50. Sealing means 59 are similarly received within the bearing sleeve 56. At one end, the spool rod is reduced in diameter to receive the piston 52, which may be held in place by any suitable means such as the locking ring 60. An O-ring or like sealing means 62 received within the recess 64 of the piston provides a gas-tight seal between the spool rod 50 and the piston 52. As shown in FIG. 2, the piston 52 is received within a cylindrical body cavity or chamber 66, within the body component 40*c*, and is normally held in a "closed" position against the end cap 46 by biasing means in the form of a compression spring 68. A gas-tight seal between an upper portion of the chamber 66, and a lower portion thereof as represented at 70 is maintained by appropriate sealing means 72, received within an outer recess 74 of the piston 52.

At an opposite end, the spool valve control 30 is provided with a chamber 76, which may be formed as an internal bore of the body component 40*a*. An end 78 of the spool rod is received within the chamber 76, through a central bore 8 of the body portion 40*a*. A leak-tight relationship between the chamber 76 and the spool rod 50 is maintained by the sealing member 82 and by the sealing member 58 in bearing 54. Within the chamber 76, the spool rod is provided with dashpot means (generally represented at 84), including an annular member 86 fixed to the end 78 of the spool rod, a relatively movable piston means 88, additional counter-biasing means 90, and adjustable bypass means 92, 108. As illustrated, the annular member 86 is received on a reduced diameter portion of the end 78 of the spool rod and is held in place by a lock ring 94. Appropriate sealing such as an O-ring 96 is provided between the annular member 86 and the spool rod 50. The annular member 86 is additionally provided with an inwardly tapered or conical surface 98 which is adapted to sealingly engage a mating surface 100 on the relatively movable piston 88. A leak-tight relation as respects the chamber 76 and a lower portion thereof 102 is maintained by the sealing means 104. The volume of the chamber 76, including the portion 102, is substantially filled with a relatively incompressible liquid such as hydraulic fluid. Counterbiasing means 90 in the form of a compression spring normally holds the conical surface 100 of the movable piston 88 in sealing contact with the conical surface 98 of the annular member 86 on the spool rod. For purposes hereinafter explained, the end 78 of the spool rod is tapped and threaded to receive a needle valve 106, which is provided with a tapered barrel 108 which is received in a tapered bore 110 in spool rod 50, to permit adjustment of the oil flow through bypass conduits 92.

Referring to the overall assembly (see FIGS. 1 and 2), the spool valve control 30 is mounted on a support bracket 109 attached to the rear of a toilet, and held in place by a lock nut 112 threadedly engaged upon the body portion 40*a*. The actuating means 32 is similarly supported on the bracket 109, for example by lock nut 114 threadedly engaged on a body portion 116 of the actuating mechanism. As illustrated in FIG. 2, the actuating means 32 is in the form of a small spool valve wherein the central spool rod or plunger 118 is held in an upthrust position within the body core 120 by means of a compression spring or like biasing member 122. Pushbutton 124 is threadedly engaged on the plunger 118 and may be manually depressed against the pressure of the spring 122 to shift the position of the plunger 118. The latter is provided with annular recessed passage means 125 which, in the position illustrated in FIG. 2, permits compressed air to enter aperture 126 from a source of supply (not shown) as received through conduit 128. The entering air passes around the plunger through passage 125 to the aperture 130, from which point it passes through conduit 132 to the chamber 66 of the spool valve control 30. The plunger 118 is also provided with annular passage means 134 which permits discharge of air entering aperture 136 (from conduit 138) through a central aperture 140 in the retainer 142 for the biasing means 122. The plunger 118 is also provided with a core passage 144 which is in communication at one end with the core chamber 120 of the actuating means and at the other end with a radial passage 146. A leak-tight seal as respects the actuator passages 125, 134, 144 and 146 is maintained by sealing means 148 interposed between the plunger 118 and body core 120 of the actuating means.

As noted previously, FIG. 2 illustrates a rest position of the control system. In such position, compressed air moves through the passage 125 in the actuating means 32 to the air supply conduit 132, and is charged by this conduit into the chamber 66 of the spool valve 30. The air pressure in the chamber 66 functions to supplement the downward pressure of the biasing means 68 to shift and hold piston 52 in a closed, sealed position, with reference to the pressure of the counterbiasing spring 90. In this position, air previously in the chamber 70 has been exhausted through the conduit 138 leading to the aperture 136 and exhaust port 140 in the actuating means. More importantly, the exhaust side of the air cylinder 28 for the toilet flapper 22 can be discharged through conduit 150, chamber 170 and conduit 138, so that the flapper can be held in closed, sealed position, as hereafter described.

FIG. 2 also illustrates an inactive or rest position as respects the supply of water and compressed air to achieve flushing of the toilet combination 10. Thus as shown in FIG. 2, the inlet conduit 152 for the flush water is in communication with a central chamber 154 within the spool valve body component 40*b*. However, the down or closed position of the spool rod and piston assembly 50, 52 causes the sealing member 156 to be compressed against the wall 157 and shoulder 158 of the body to prevent any flow of flush water to the flushing conduit 160. In like fashion, as hereinafter explained, the air passages within the spool valve 30 leading to the air flushing conduit 162 are blocked, so that there is no possibility that a charge of compressed air will be accidentally introduced into the base chamber 18. Finally, the air passages to effect opening of the flapper 22, specifically the conduit 164 leading to the control cylinder 28, are likewise blocked. Thus, in the position of the control mechanism shown in FIG. 2, the flapper is held in closed, sealed position by the air cylinder 28, the water supply in line 152 is blocked, and the air passage means to evacuate the base chamber 18 are sealed.

Figure 3:
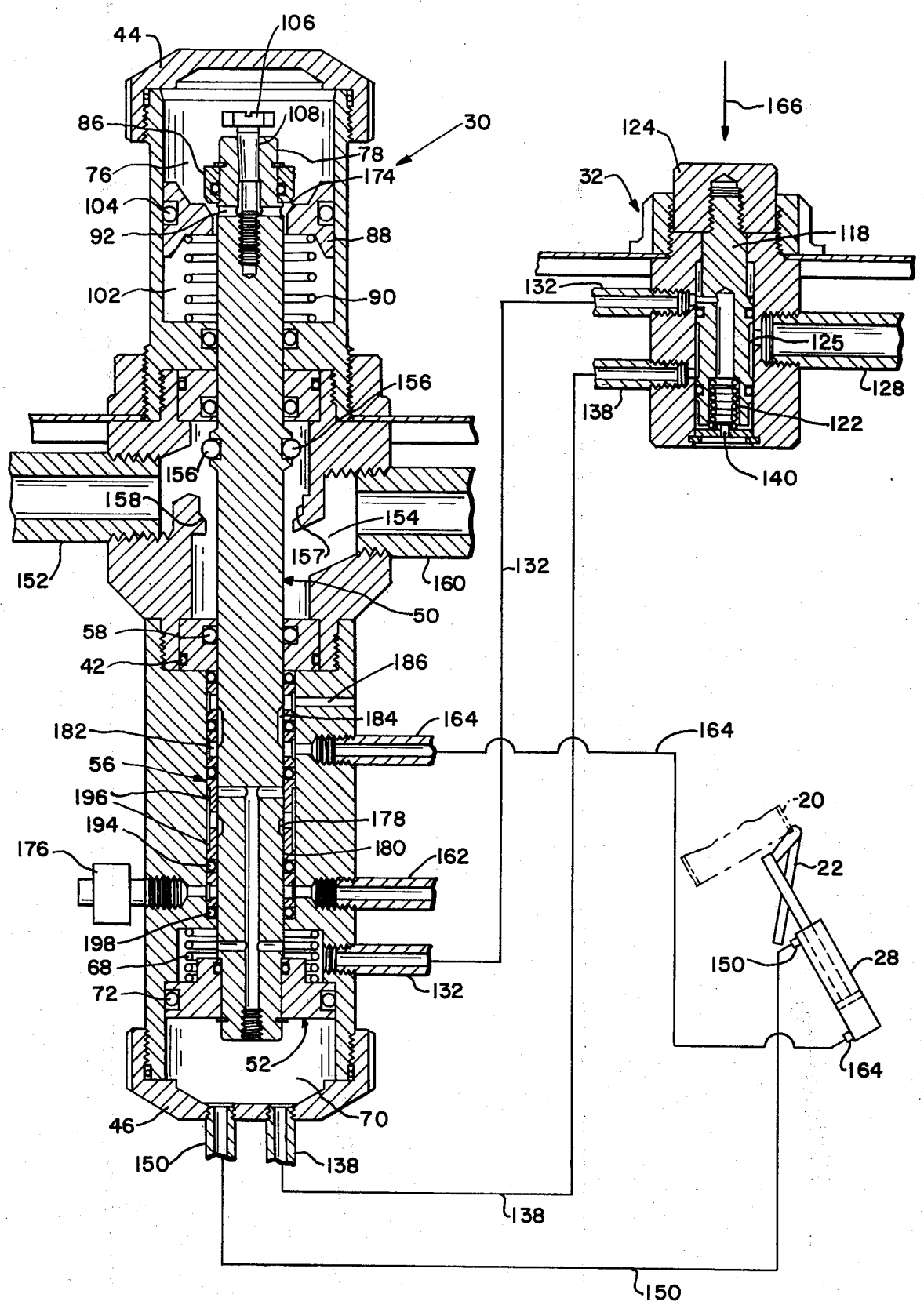
FIGS. 3 through 7 are like views showing different stages in the operation of the apparatus.

FIG. 3 illustrates the positioning of the parts, following actuation of the spool valve means 30 by the pushbutton 124 (see arrow 166). As illustrated, depressing the button 124 causes the plunger 118 to move against the pressure of the spring 122 to the position illustrated. In this position, the compressed air in conduit 128 is diverted through passage 125 to the conduit 138 leading to the lower chamber 70 in the spool valve. The result is to immediatedly shift the spool rod and piston assembly 50, 52 upward against the pressure of the biasing means 68. Such movement causes the water seal 156 to move away from the shoulder 158 and wall 157, thereby permitting flush water to pass from the inlet conduit 152 through chamber 154 to the flush water supply conduit 160. As illustrated in FIG. 1, the flush water is discharged circumferentially through the opening 168 so that it swirls and cascades down the inner wall 170 of the toilet bowl in a flushing action. Simultaneously, the air pressure in the lower chamber 70 causes compressed air to pass through the conduit 150 to the opposite side of the control cylinder 28, to effect a downward pivoting and opening of the flapper 22. At the same time, the end 78 of the piston rod is thrust upward into the chamber 76 at a faster rate than the relatively movable piston 88. This opens an annular passage 174 between the conical surfaces 98 and 100 of the dashpot components 86 and 88, permitting hydraulic fluid to flow into the chamber 102 from the chamber 76. It will be understood that the actuation of pushbutton 124 need only be a momentary thing, as the spool rod and piston shaft almost instantaneously to cause flush water to be introduced to the toilet bowl 14. The reversal of the control cylinder 28 to shift the flapper 22 to open position, is likewise achieved almost instantaneously by the actuating means 32.

Although the rapid shifting of the spool rod causes the annular member 86 to shift faster than the relatively movable piston 88, the counterbiasing spring 90 will act within a very short period of time to return the relatively movable piston 88 to a sealing position adjacent the annular element 86. During this interval, the components 86, 88, 90 function to provide a "dashpot" effect, enabling hydraulic fluid to move from the chamber 76 to the chamber 102 to accommodate the rapid shifting of the end 78 of the spool rod. However, when the conical surfaces 98 and 100 again engage in a sealing relation (see FIG. 4), the only means of fluid communication between the chambers 76 and 102 is the bypass pathway between the tapered barrel 108 and tapered bore 110, in the needle valve, and the transverse conduits 92 in the spool valve. As noted hereafter, the rate of flow of hydraulic fluid controls the speed of the return stroke of the spool rod and piston assembly 50, 52.

It is a feature of the invention that throughout the upward movement of the spool rod and piston assembly, compressed air is prevented from entering the conduit 162 leading to the base chamber 18 by the internal configuration of the spool valve. Thus at the start of the upstroke, because of the sealing action of adjacent O-rings 194 and 198, the conduit 162 is in communication only with a pressure release valve 176 through annular spool passage 178. The release valve 176 is set at a sufficiently high pressure (i.e. 20 p.s.i., gauge) so that it remains normally inoperative. On shifting of the spool valve from the rest position of FIG. 2, to the upthrust position of FIG. 3, the spool valve presents an uninterrupted outer surface 180 which cooperates with the O-rings 194, 198 to prevent any passage of air to the conduit 162. It is noted, however, that the conduit 164 to the control cylinder 28 is in communication through the spool passage 182 with an annular indent passage 184 in the spool rod 50. The latter communicates, in turn, with a discharge vent passage 186 in the spool body, thus venting the control cylinder 28 for the flapper 22. It is further noted that any excess compressed air charged to the chamber 70 is vented through the conduit 138 to the previously mentioned discharge port 140 in the actuating spool valve 32.

Figure 4:
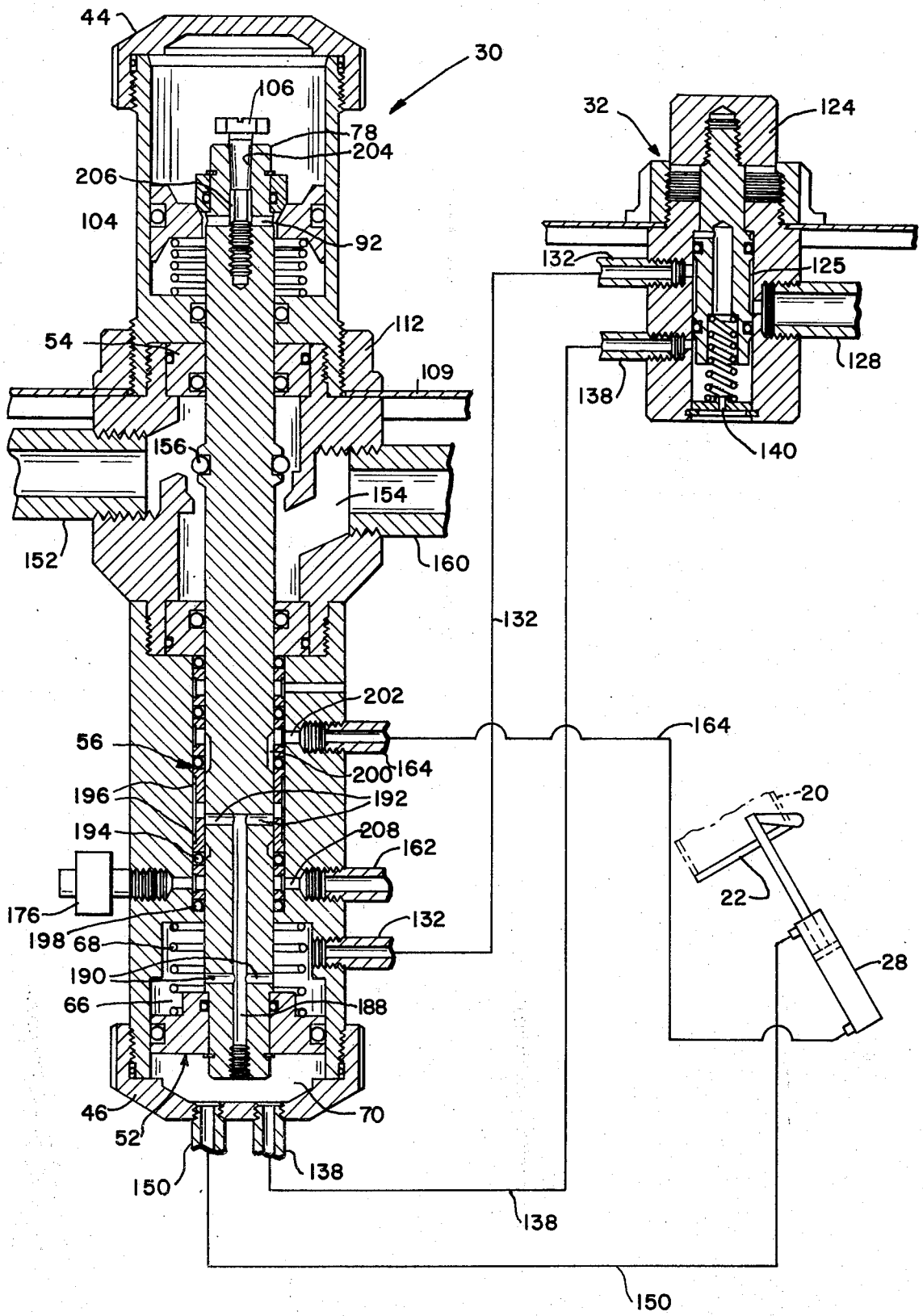

FIG. 4 illustrates the condition of the control system following release of the actuating pushbutton 124. It will be appreciated that release of the button 124 returns the actuating spool valve 32 to its rest position so that the supply of compressed air to the conduits 132 and 138 is reversed. As a result, compressed air passes from the conduit 128 through the passage 125 to the conduit 132, causing compressed air to re-enter the chamber 66 for purposes of causing the spool rod and the piston assembly 50, 52 to return to its original position. This operation is assisted by the biasing means 68. Although compressed air can enter an internal bore 188 within the spool rod, and exit through the radial passages 192, it is prevented from reaching the air flush inlet conduit 162 by interposition of the sealing O-ring 194. However, compressed air is released from the internal bore 188 through the radial passages 192 to annular core passages (designated 196) which are available in the sleeve portion 56 of the body. The passages 196 communicate with a recessed annular passage 200 in the surface of the spool rod 50 which, in turn, communicates through the aperture 202 to the conduit 164 for the control cylinder 28. This internal movement of compressed air through the spool valve control means causes the control cylinder 28 to shift the flapper 22 to closed position, air being discharged from the control cylinder 28 through the conduit 150, chamber 70 and conduit 138 to the vent port 140. Accordingly, in the condition of the control system shown in FIG. 4, the flapper seal between the toilet bowl 14 and base chamber 18 is closed, but water continues to be introduced to the toilet bowl through the conduits 152 and 160. The purpose, of course, is to continue introduction of water to achieve a standing water level within the toilet subsequent to the flushing operation. Although the base chamber 18 is now sealed, no air has been introduced to initiate the air flush operation.

As previously noted, the speed of the return movement of the spool rod and piston assembly 50, 52 is regulated by the rate of flow of hydraulic fluid from the chamber 102 to the chamber 76, through the bypass passages 92 and the passage 204 in the needle valve 106. The actual rate of this return movement is therefore substantially slower than the initial upward shifting movement, following actuation of the flushing operation. It will be appreciated that the rate of speed of the return stroke can be controlled by adjusting the needle valve to enlarge or restrict the passage 204 between the tapered barrel and bore 108, 110, leading to the bypass conduits 92. More specifically, with reference to FIG. 4, downward adjustment of the needle valve 106 will further restrict the passage 204, to thereby decrease the downward speed of the spool rod and piston assembly 50, 52, whereas upward adjustment of the needle valve will enlarge the passage 204 to increase the speed of the return movement.

Figure 5:
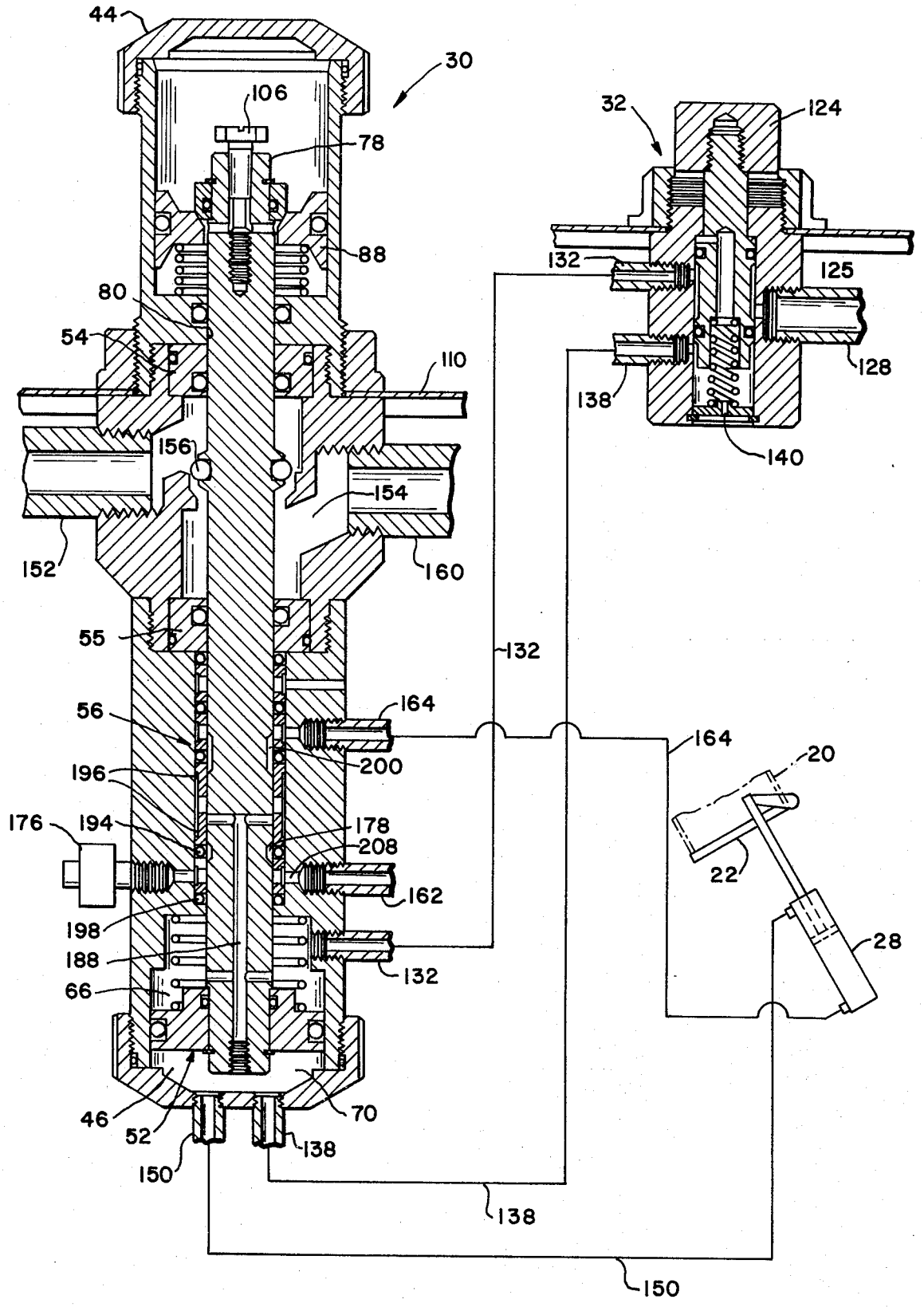

FIG. 5 illustrates a further position in the return stroke of the spool rod and piston assembly 50, 52, under the conditions just described. In this position, the supply of air through conduit 132 to the chamber 66 remains the same so that the air pressure within the chamber 66 cooperates with the biasing means 68 to return the piston 52 to its initial position. Also, air continues to be evacuated from the chamber 70 through the conduit 138 and exhaust port 140. In addition, the air passages from the chamber 66 through the internal conduit 188 to the conduit 164 for the flapper cylinder 28 remain open to hold the flapper 22 in the closed sealed position, such condition also being insured by the venting of the discharge side of the control cylinder 28 through conduits 150 and 138, to the vent port 140.

In specific contrast to FIG. 4, FIG. 5 shows a condition of the parts where compressed air is introduced through the conduit 162 to initiate air flushing of the base chamber 18. This occurs through movement of the annular spool rod depression 178 to a position where it bypasses the seal 194, and can communicate with the aperture 208 leading to the supply conduit 162. As a consequence, compressed air is enabled to pass from the chamber 66 through the internal bore 188 and conduits 190, 192 and the annular core passages 196 and 178 to the conduit 162, so that a blast of air is delivered to the base chamber 18 to effectively discharge the flush water and contents through the outlet 34, 36 (see FIG. 1). It is a feature of the present invention that such air blast occurs only when the flapper 22 is in the closed sealed position, thereby eliminating the possibility of accidental discharge of compressed air into the toilet bowl 14. In this regard, there is no possibility of air being introduced to the supply conduit 162 on the upstroke of the spool rod, because the upstroke is accomplished only when the actuating button 124 is depressed to enable compressed air to be charged to the spool valve chamber 70 (see FIG. 3).

Figure 6:
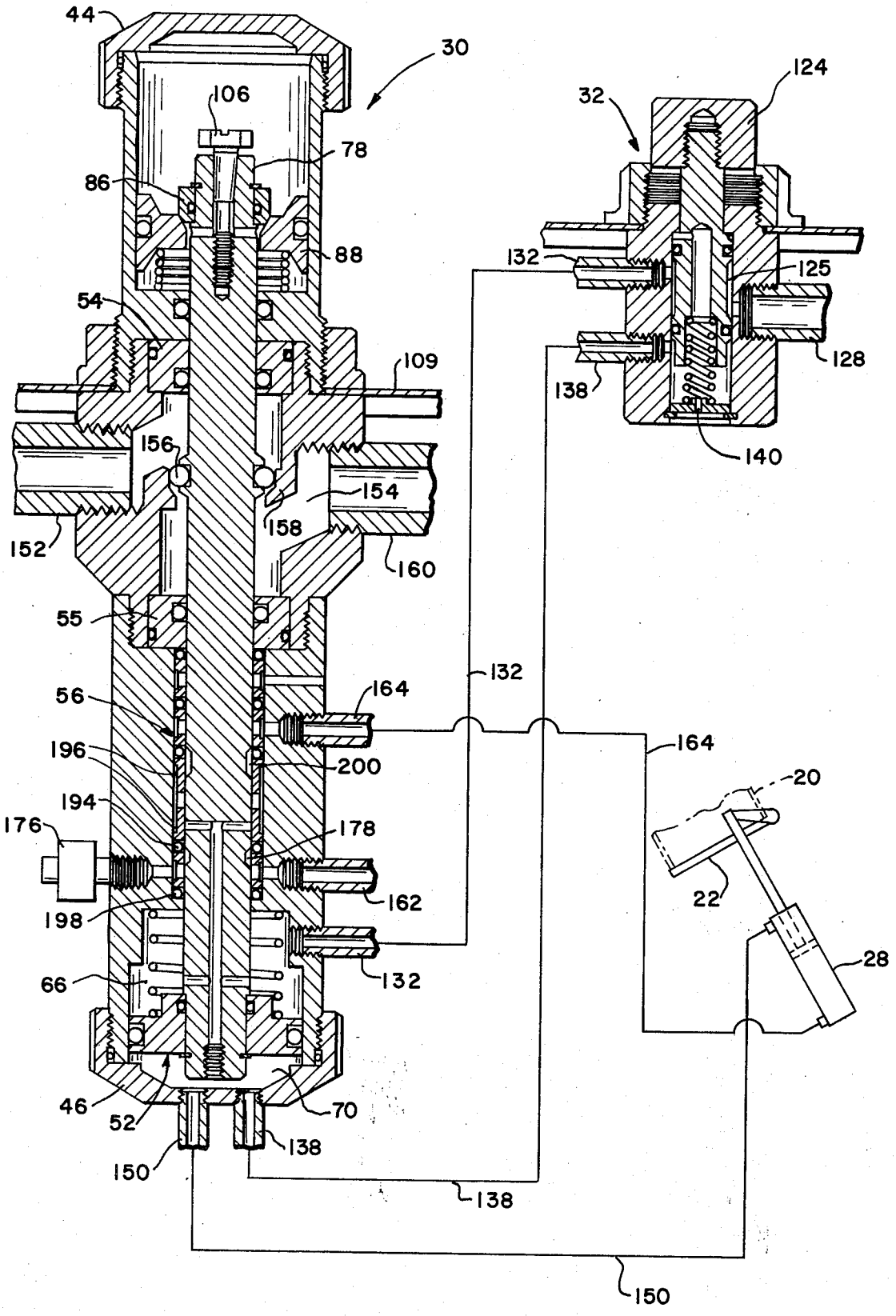

With further reference to FIG. 5, it is noted that some water is still flowing into the toilet bowl 14 through the water supply conduit 152, spool valve chamber 154 and conduit 160. However, on continuance of the downstroke of the spool rod to the position shown in FIG. 6, the sealing member 156 comes into contact with the surface of the cylindrical bore 157 immediately above the shoulder 158, thereby interrupting the flow of water to the toilet bowl 14. At this point, the toilet sould be filled to the standing water level, as represented in FIG. 1. FIG. 6 also illustrates a continuing position for introduction of the compressed air through the conduit 162, to effect the air flushing of the base chamber 18 in the manner just described in conjunction with FIG. 5.

Figure 7:
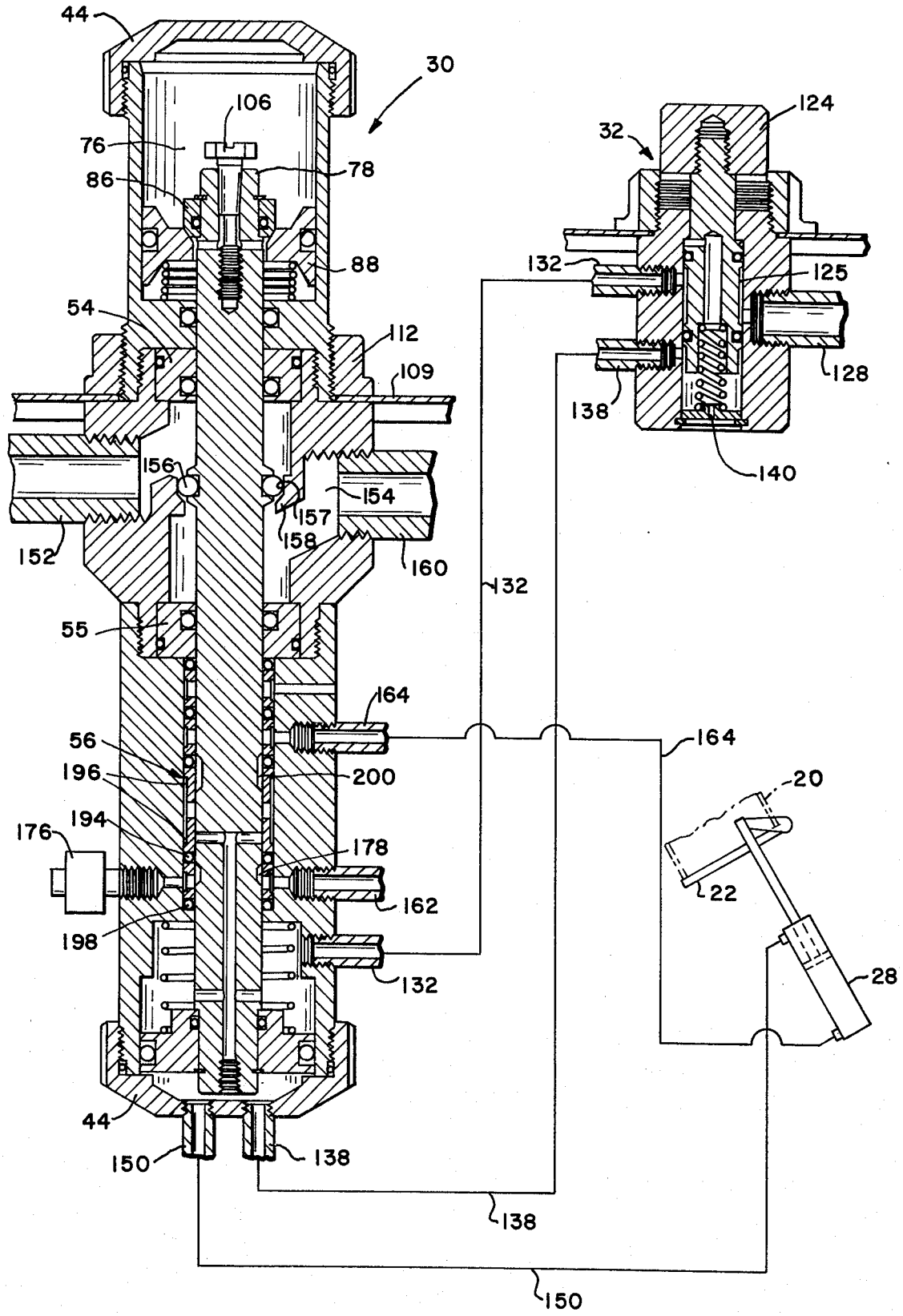

FIG. 7 illustrates the condition of the control system as the spool rod and piston assembly 50, 52 nears the end of the return stroke. In this position, the charge of air to the base chamber 18 is shut off by a positioning of the O-rings 194 and 198 on either side of the annular spool rod depression 178. The supply of flush water remains cut off by the sealing interaction between the seal 156 and the core wall 157 and shoulder 158. The flapper 22 remains in closed position through passage of air from chamber 66 through bore 188, conduits 90, 192 and 190, conduit 164.

The final return position of the spool rod and piston assembly 50, 52 is achieved when these parts reach the "rest" position, as initially described with reference to FIG. 2.

In accordance with the embodiment of the invention illustrated in the drawings, the control functions described above are achieved by specific positions in the travel of the spool rod and piston assembly 50, 52. In a satisfactory commercial embodiment of the invention, the upward thrust of the spool rod can be specified in terms of linear dimensions, as particularly illustrated in FIG. 8. Thus, the illustrated upstroke of the spool rod 50 is 0.500 inch, and is represented by the arrow 220. Assuming that arrow 220 represents the full upward shifting of the spool rod, the lower terminus of the arrow 220 corresponds with the rest position of FIG. 2, and is so designated in FIG. 8. In like fashion, the upper terminus of arrow 220 corresponds to the shifted position of the spool rod shown in FIG. 3, and such position is designated in FIG. 8 as FIG. 3. Similarly, the arrow 222 represents the down stroke of the spool rod assembly. More specifically, the position of the parts 0.200 inches from the initial rest position (i.e. after a return stroke of 0.300 inches) is shown at the point designated in FIG. 8 as FIG. 4. The designation FIG. 5 in FIG. 8 represents that the piston rod assembly is 0.150 inch from the initial rest position, whereas the position designated FIG. 6 corresponds to a position of spool rod assembly 0.100 inches from the bottom, and FIG. 7 to a position 0.050 inches from the bottom.

Figure 8:
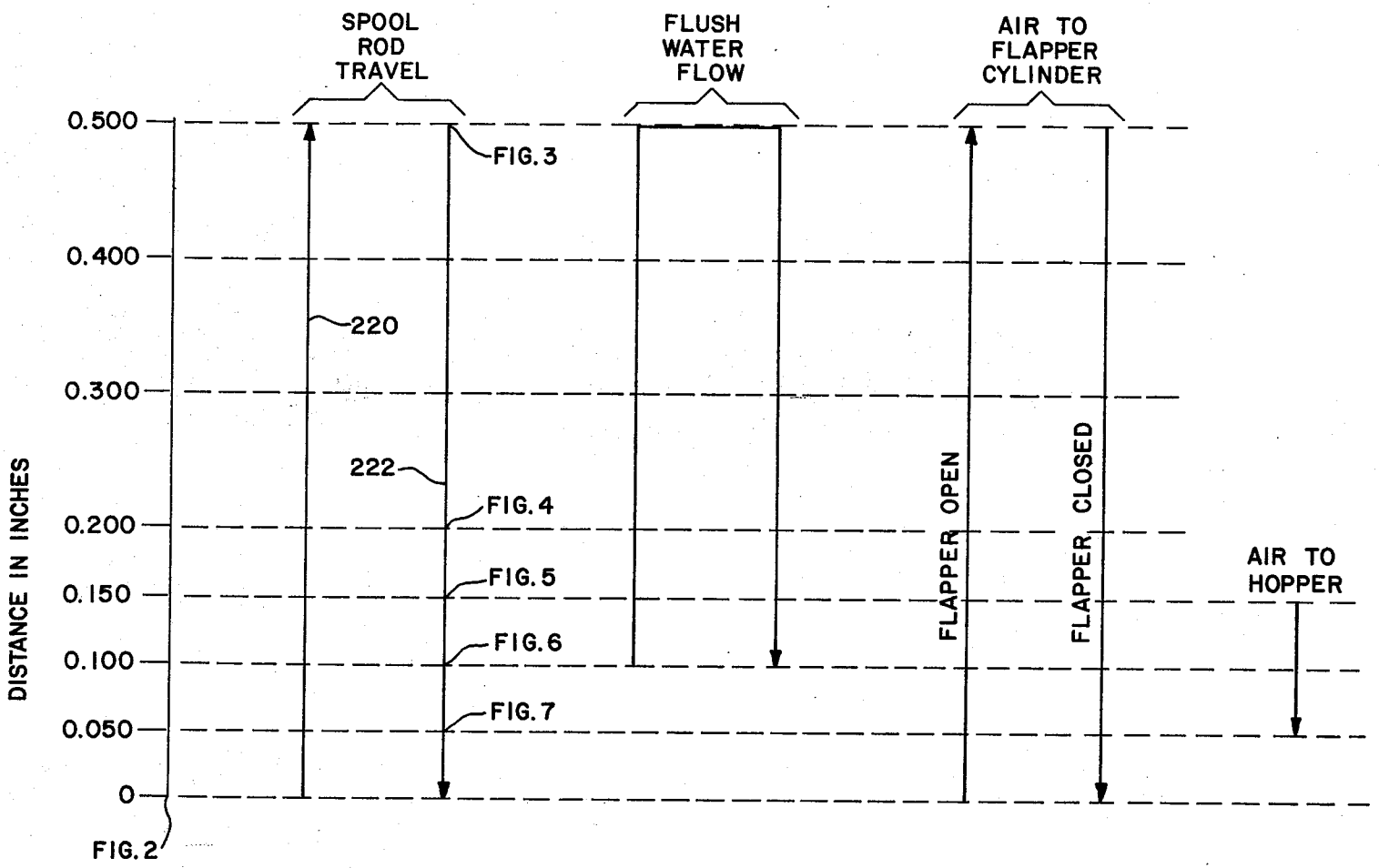
FIG. 8 is a schematic representation, in chart form, showing the relative positions of certain of the control elements at different stages in the operation of the control system.

In like fashion, FIG. 8 shows that flush water is introduced to the toilet bowl 14 only at such time as the spool rod assembly has been moved upward 0.100 inches, and that introduction of flush water continues throughout the remainder of the upstroke and through the return stroke, until such time as the spool rod assembly has reached a point 0.100 inches from the initial rest position, that is, as shown in FIG. 6. FIG. 8 additionally shows that the flapper 22 is immediately opened upon actuation of the flushing control (by the pushbutton 124), and that the flapper 22 remains open throughout the upstroke of the spool rod assembly. However, upon releasing the button 124, the flapper 2 is closed, and remains closed throughout the downstroke of the piston assembly. Stated another way, the flapper 22 remains closed at each of the positions designated FIG. 3 through FIG. 7 in FIG. 8, which points represent the linear travel in inches during the return stroke.

Finally, FIG. 8 shows that the air flush of the base chamber commences only at such time as the spool rod assembly has returned to a point 0.150 inches from the initial or starting position, and continues until such time as the spool rod assembly has reached 0.050 inches from the bottom. As respects the introduction of air through the supply conduit 162, FIG. 8 shows that the levels designated FIG. 5, FIG. 6 and FIG. 7 correspond with positions 0.150, 0.100 and 0.050 inches from the starting point, respectively.

Employing the improved spool valve control system and method of the present invention, flushing of a toilet combination of the type illustrated can be accomplished with very small amounts of water and air. In a typical installation, flushing will require no more than about 1 to 1.5 liters (e.g., approximately 1 to 1.5 quarts) of water and 15 to 30 liters (e.g., approximately 0.5 to 1.0 cubic feet) of air, at standard temperature and pressure. Flushing times with the described control, will range from 8 to 10 seconds for the entire flushing cycle, of which about 3 to 6 seconds is occupied with the water flush and about 4 to 7 seconds with the air flush. In terms of movement of the spool rod and piston assembly 50, 52, about one second or less is required for the upstroke and about 1 to 10 seconds for the return stroke.

From the foregoing, it will be apparent that the present invention provides a novel and improved control system for a combination water and air flush toilet, whereby the toilet can be flushed in an easy, convenient, economical manner with greatly reduced requirements of both flush water and compressed air for the flushing operations. The improved control system for the described flushing operations is very compact in construction and relatively foolproof in operation. Specifically, the spool valve control means herein described, together with the spool valve actuating means therefor, can be positioned in a very small space adjacent the toilet or, if desired, at a position remote from the toilet. Since the only moving parts are in the form of spool valve bodies, rod and piston assemblies and dashpot mechanisms, which require no complicated mechanical linkages or valving arrangements, an improved control system is provided which is essentially maintenance-free, compact, sturdy and adapted to a wide range of control requirements for various types of toilet systems, including both fixed or stationary units and mobil units for various applications.

I claim:

1. In a combination toilet particularly adapted for mobile use, wherein a bowl portion is supported above a base chamber and cooperating means are provided to introduce water to flush said bowl portion and to introduce compressed air to discharge the contents of said base chamber, and wherein fluid communication between said bowl portion and base chamber is regulated by sealing means movable between a closed position sealing said bowl portion from said base chamber and an open position providing communication therewith: the improvement, comprising, unitary spool valve means to selectively and sequentially control the operations of said movable sealing means and said cooperating means to introduce water to said bowl portion and air to said base chamber of the toilet, said spool valve means including conduit means to effect air discharge of said base chamber only at such time as said movable sealing means is in said closed position to prevent passage of water or air between said bowl portion and said base chamber of the toilet, and means to actuate said spool valve means to sequentially control the movement of said sealing means to said open position, the introduction of flush water to said bowl portion, the closing of said sealing means, the introduction of air to said base chamber, the termination of water introduction to said bowl portion, and the termination of air introduction to said base chamber.

2. A combination toilet as in claim 1 wherein said movable sealing means comprises flapper means pivotally mounted between said bowl portion and base chamber for movement from a closed sealing position adjacent the bowl portion to an open position within said base chamber, and means operatively controlled by said spool valve means for shifting said flapper means between said open and closed positions, whereby introduction of compressed air into said base chamber when the flapper means is in said closed sealed position will serve to increase the sealing function of said flapper means.

3. A combination toilet as in claim 1 wherein said spool valve means includes a body portion having separate apertures leading to a source of flush water and to a source of compressed air, a shiftable internal spool rod and piston, and biasing means to shift the spool rod and piston to a preselected closed position, said spool rod having passage means adapted to selective registry with said apertures in said body but normally positioned out of registry due to the shifting of said spool rod to said closed position by said biasing means.

4. A combination toilet as in claim 3 wherein said means to actuate said spool valve means includes means to divert compressed air from said source of compressed air to shift said spool rod and piston against the pressure of said biasing means.

5. A combination toilet as in claim 4 wherein the passage means in said spool rod and said separate apertures in said spool body are in registry, following actuation of said actuating means to shift said spool rod and piston, and said actuating means is in registry to introduce air from said source of compressed air to means shifting said sealing means to open position and to means introducing flush water to said toilet bowl.

6. A combination toilet as in claim 3 wherein said spool valve means includes an internal chamber provided with dashpot means and additional biasing means tending to counteract the closing effect of said biasing means, said internal chamber being substantially filled with relatively incompressible fluid, said dashpot means and additional biasing means serving to control the speed with which said spool rod and piston return to said preselected closed position, in response to return pressure of said biasing means.

7. A combination toilet as in claim 6 including bypass means associated with said dashpot means and means to adjust the flow of said relatively incompressible fluid therethrough to thereby provide control over the speed with which said biasing means effects return of said spool rod and piston.

8. A combination toilet as in claim 4 wherein the spool valve conduit means to effect air discharge of said base chamber only at such time as said movable sealing means is in closed sealed position, includes: conduit means leading from said spool valve to means for shifting said movable sealing means, conduit means leading from said spool valve to said base chamber, and internal conduit means within said spool valve, operable only at such time as the return stroke of said spool rod has reached a position where said movable sealing means is in closed sealed position.

9. A combination toilet as in claim 1 wherein said means to actuate the spool valve means includes an additional separate spool valve means in communication with a source of compressed air, said additional spool valve means being shiftable upon actuation and release to deliver compressed air to opposite sides of said spool valve piston.

* * * * *